US005588198A

United States Patent [19]

Kawahata et al.

[11] Patent Number: 5,588,198

[45] Date of Patent: Dec. 31, 1996

[54] METHOD OF REGULATING RESONANCE FREQUENCY OF SURFACE-MOUNTABLE ANTENNA

[75] Inventors: Kazunari Kawahata; Yuichi Kushihi, both of Kyoto, Japan

[73] Assignee: Murata Manufacturing Co., Ltd., Japan

[21] Appl. No.: 399,238

[22] Filed: Mar. 6, 1995

[30] Foreign Application Priority Data

Mar. 9, 1994 [JP] Japan ..... 6-038680

[51] Int. Cl.[6] ..... H01P 11/00

[52] U.S. Cl. ..... 29/600; 343/702; 343/745; 343/767

[58] Field of Search ..... 343/702, 745, 343/767; 29/600

[56] References Cited

U.S. PATENT DOCUMENTS 3,381,371 5/1968 Russell ..... 29/600
5,268,702 12/1993 Amano et al. ..... 343/702 X

FOREIGN PATENT DOCUMENTS 5175719 7/1993 Japan .

*Primary Examiner*—Carl J. Arbes
*Attorney, Agent, or Firm*—Ostrolenk, Faber, Gerb & Soffen, LLP

[57] ABSTRACT

A method of regulating the resonance frequency of a surface-mountable antenna includes (a) a step of preparing a surface-mountable antenna including a substrate which is made of a dielectric material, a groove which is formed on an upper surface of the substrate to have end portions at a pair of opposite end surfaces of the substrate, a radiating electrode which is formed on the inner peripheral surface of the groove, a feeding electrode which is formed on one of the pair of opposite end surfaces of the substrate and connected with the radiating electrode, a ground electrode which is formed on one of the pair of end surfaces and insulated from the feeding electrode, and an end electrode which is formed on the other one of the pair of opposite end surfaces of the substrate, and (b) a step of either (1) partially trimming the radiating electrode, the ground electrode or the end electrode, or (2) mounting a dielectric member on the substrate, for changing the resonance frequency of the surface-mountable antenna. It is possible to change capacitance and inductance components which are present in the substrate by partially trimming the radiating electrode, the ground electrode or the end electrode, or by mounting a dielectric member on the substrate, thereby regulating the resonance frequency of the surface-mountable antenna to a desired value.

12 Claims, 3 Drawing Sheets

METHOD OF REGULATING RESONANCE FREQUENCY OF SURFACE-MOUNTABLE ANTENNA

BACKGROUND OF THE INVENTION

1. Field of the Invention

The present invention relates to a method of regulating the resonance frequency of a surface-mountable antenna which is employable with a mobile communication device or the like.

2. Description of the Background Art

The structures of conventional surface-mountable antennas are now described with reference to FIGS. 4 and 5 showing perspective views of such antennas 1 and 11.

Referring to FIG. 4, the surface-mountable antenna 1 comprises a substrate 2 which is made of a dielectric material such as ceramic. The substrate 2 is provided on its upper surface 2*c* with a groove 3 having end portions 3*a* and 3*b* at a pair of opposite end surfaces 2*a* and 2*b* respectively. A conductor is applied to the inner peripheral surface of the groove 3, thereby forming a radiating electrode 4. Further, a conductor is applied around the end portion 3*a* of the groove 3 on the end surface 2*a* of the substrate 2, thereby forming a feeding electrode 5 in connected to the radiating electrode 4. In addition, conductors are applied to both end portions of the end surface 2*a* of the substrate 2, thereby forming ground electrodes 6 insulated from the feeding electrode 5. Further, a conductor is applied to the overall end surface 2*b* of the substrate 2, thereby forming an end electrode 7.

In the surface-mountable antenna 1 having the aforementioned structure, the resonance frequency and the frequency bandwidth are decided by a capacitance component which is formed by the ground electrodes 6 and the end electrode 7 and an inductance component which is present in the radiating electrode 4, so that the radiating electrode 4 transmits/receives electric waves.

Referring to FIG. 5, on the other hand, the surface-mountable antenna 11 comprises a substrate 12 which is made of a dielectric material such as ceramic. The substrate 12 is provided with a through hole 13 having opening portions 13*a* and 13*b* at a pair of opposite end surfaces 12*a* and 12*b* respectively. A conductor is applied to the inner peripheral surface of the through hole 13, thereby forming a radiating electrode 14. Further, a conductor is applied around the opening portion 13*a* of the through hole 13 which is formed at the side surface 12*a* of the substrate 12, thereby forming a feeding electrode 15 connected with the radiating electrode 14. In addition, conductors are applied to both end portions of the end surface 12*a* of the substrate 12, thereby forming ground electrodes 16 insulated from the feeding electrode 15. Further, a conductor is applied to the overall end surface 12*b* of the substrate 12, thereby forming and end electrode 17.

In the surface-mountable antenna 11 having the aforementioned structure, the resonance frequency and the frequency bandwidth are decided by a capacitance component which is formed by the ground electrodes 16 and the end electrode 17 and an inductance component which is present in the radiating electrode 14, so that the radiating electrode 14 transmits/receive electric waves.

In measurement of the resonance frequency, the surface-mountable antenna 1 or 11 is mounted on a substrate (not shown) and connected to a measuring device (not shown) such as a network analyzer. If a desired resonance frequency is not attained as the result of such measurement, this antenna is regarded as a defective, assuming no regulation of the resonance frequency possible.

If every such surface-mountable antenna which cannot attain a desired resonance frequency is regarded as a defective unit, however, the non-defective yield of the surface-mountable antenna is disadvantageously reduced, which increases the effective cost of each non-defective unit.

SUMMARY OF THE INVENTION

An object of the present invention is to improve the non-defective yield of a surface-mountable antenna.

Another object of the present invention is to enable regulation of the resonance frequency of a surface-mountable antenna to a desired value.

A method of regulating the resonance frequency of a surface-mountable antenna according to the present invention comprises the step of preparing a surface-mountable antenna including a substrate which is made of a dielectric material, a groove which is provided on an upper surface of the substrate to have end portions at a pair of opposite end surfaces of the substrate, a radiating electrode which is formed on the inner peripheral surface of the groove, a feeding electrode which is formed on one of the pair of opposite end surfaces of the substrate in series with the radiating electrode, a ground electrode which is formed on one of the pair of end surfaces to be insulated from the feeding electrode, and an end electrode which is formed on the other one of the pair of opposite end surfaces of the substrate, and the step of partially trimming the radiating electrode, the ground electrode or the end electrode for changing the resonance frequency of the surface-mountable antenna.

When the radiating electrode, the ground electrode or the end electrode is partially trimmed, the capacitance and inductance components which are present in the substrate are changed. Therefore, it is possible to regulate the resonance frequency of the surface-mountable antenna having the groove which is provided in the substrate of a dielectric material and the radiating electrode which is formed in this groove to a desired value.

Thus, it is not necessary to regard products of the surface-mountable antenna which cannot attain desired resonance frequencies as defectives, but rather the non-defective yield of the surface-mountable antenna products can be improved by regulating their resonance frequencies, thereby reducing the cost of manufacturing the surface-mountable antenna products.

A method of regulating the resonance frequency of a surface-mountable antenna according to another aspect of the present invention comprises the steps of preparing a surface-mountable antenna including a substrate which is made of a dielectric material, a through hole which is formed in the substrate to have opening portions at a pair of opposite end surfaces of the substrate, a radiating electrode which is formed on the inner peripheral surface of the through hole, a feeding electrode which is formed on one of the pair of opposite end surfaces of the substrate in series with the radiating electrode, a ground electrode which is formed on one of the pair of end surfaces to be insulated from the feeding electrode, and an end electrode which is formed on the other one of the pair of opposite end surfaces of the substrate, and partially trimming the radiating electrode, the ground electrode or the side electrode for changing the resonance frequency of the surface-mountable antenna.

When the radiating electrode, the ground electrode or the side electrode is partially trimmed, the capacitance and inductance components which are present in the substrate are changed. Therefore, it is possible to regulate the resonance frequency of the surface-mountable antenna having the through hole which is provided in the substrate of a dielectric material and the radiating electrode which is formed therein to a desired value.

Thus, it is not necessary to regard products of the surface-mountable antenna which cannot attain desired resonance frequencies as defectives, but rather the non-defective yield of the surface-mountable antenna products can be improved by regulating their resonance frequencies, thereby reducing the cost of manufacturing the surface-mountable antenna products.

A method of regulating the resonance frequency of a surface-mountable antenna according to still another aspect of the present invention comprises the steps of preparing a surface-mountable antenna including a substrate which is made of a dielectric material, a through hole which is formed in the substrate to have opening portions at a pair of opposite end surfaces of the substrate, a radiating electrode which is formed on the inner peripheral surface of the through hole, a feeding electrode which is formed on one of the pair of opposite end surfaces of the substrate in series with the radiating electrode, a ground electrode which is formed on one of the pair of end surfaces to be insulated from the feeding electrode, and an end electrode which is formed on the other one of the pair of opposite end surfaces of the substrate, and mounting a dielectric member on the upper surface of the substrate in a portion close to either opening position of the through hole for changing the resonance frequency of the surface-mountable antenna.

When the dielectric member is mounted on the upper surface of the substrate in a position close to either opening portion of the through hole, the capacitance and inductance components which are present in the substrate are changed. Therefore, it is possible to regulate the resonance frequency of the surface-mountable antenna having the through hole which is provided in the substrate of a dielectric material and the radiating electrode which is formed therein to a desired value.

Thus, it is not necessary to regard products of the surface-mountable antenna which cannot attain desired resonance frequencies as defectives, but the non-defective yield of the surface-mountable antenna products can be improved by regulating their resonance frequencies, thereby reducing the cost of manufacturing the surface-mountable antenna products.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1A:
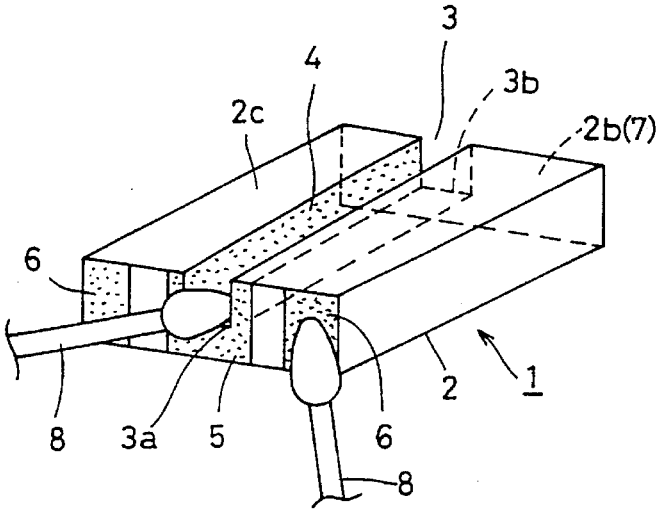
FIG. 1A is a perspective view showing the trimming of each electrode of a surface-mountable antenna according to a first embodiment of the present invention.

Methods of regulating the resonance frequencies of surface-mountable antennas according to embodiments of the present invention are now described with reference to FIGS. 1A to 3. Portions identical or equivalent to those of the prior art are denoted by the same reference numerals, to omit redundant description.

The feature of the present invention resides in the following point: In a method of regulating the resonance frequency of a surface-mountable antenna, capacitance and inductance components which are present in the surface-mountable antenna are changed by trimming a radiating electrode, a ground electrode or an end electrode, or mounting a dielectric member on the substrate.

First Embodiment

A first embodiment of the present invention is now described with reference to FIGS. 1A and 1B.

Figure 1B:
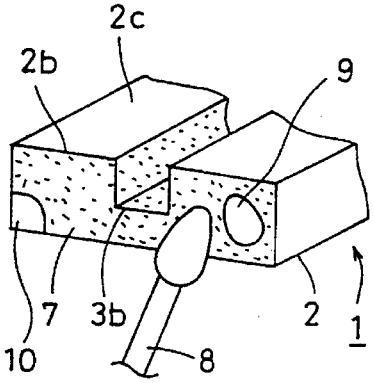
FIG. 1B is another partially fragmented perspective view showing the trimming of each electrode of the surface-mountable antenna according to the first embodiment of the present invention.

If the resonance frequency of a surface-mountable antenna 1 which is shown in FIGS. 1A and 1B in perspective views is different from a desired value, a router 8 is appropriately pressed against a radiating electrode 4, a ground electrode 6 or a side electrode 7 which is provided on a substrate 2, to partially trim this electrode. Thus, capacitance and inductance components which are present in the surface-mountable antenna 1 are changed to change the value of the resonance frequency as obtained. When such electrode trimming is carried out to leave the electrode in the overall periphery of a trimmed region 9 as shown in FIG. 1B, it is possible to lower the resonance frequency if the same is too high. When the electrode is only partially left in the periphery of a trimmed region 10 of the electrode as shown in FIG. 1B, on the other hand, it is possible to increase the resonance frequency if the same is too low. Thus, the method of regulating the resonance frequency is so executed as to trim the electrode until the resonance frequency reaches the desired value.

While this embodiment has been described with reference to a case of regulating the resonance frequency with a router, the present invention is not restricted to this but it is possible to attain a similar effect by trimming the electrode through laser trimming.

Second Embodiment

A second embodiment of the present invention is now described with reference to FIGS. 2A and 2B.

Figure 2A:
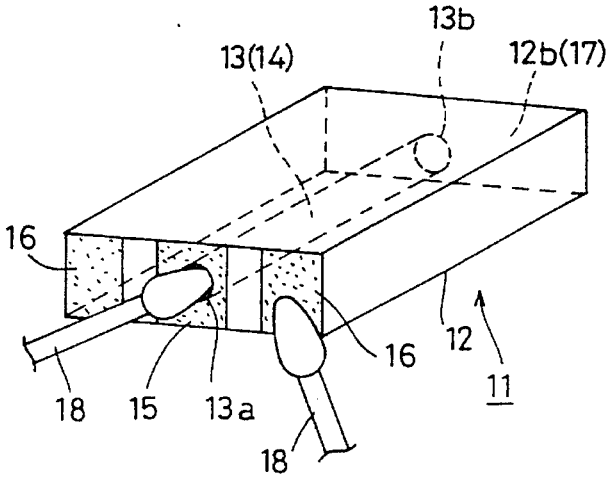
FIG. 2A is a perspective view showing the trimming of each electrode of a surface-mountable antenna according to a second embodiment of the present invention.
Figure 2B:
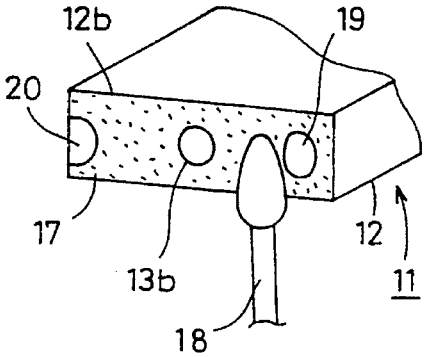
FIG. 2B is another partially fragmented perspective view showing the trimming of each electrode of the surface-mountable antenna according to the second embodiment of the present invention.

When the resonance frequency of a surface-mountable antenna 11 shown in FIGS. 2A and 2B in perspective views is lower than a desired value, a router 18 is appropriately pressed against a radiating electrode 14, a ground electrode 16 or a side electrode 17 which is provided on a substrate 12, to partially trim this electrode. Thus, capacitance and inductance components which are present in the surface-mountable antenna 11 are changed to change the value of the resonance frequency as obtained. When the electrode is left in the overall periphery of a trimmed region 19 as shown in FIG. 2B, it is possible to lower the resonance frequency if the same is too high. When the electrode is only partially left in the periphery of a trimmed region 20 of the electrode as shown in FIG. 2B, on the other hand, it is possible to increase the resonance frequency if the same is too low. Thus, the method of regulating the resonance frequency is so executed as to trim the electrode until the resonance frequency reaches the desired value.

While this embodiment has been described with reference to a case of regulating the resonance frequency with a router, the present invention is not restricted to this but it is possible to attain a similar effect by trimming the electrode through laser trimming, similarly to the first embodiment.

Third Embodiment

Figure 3:
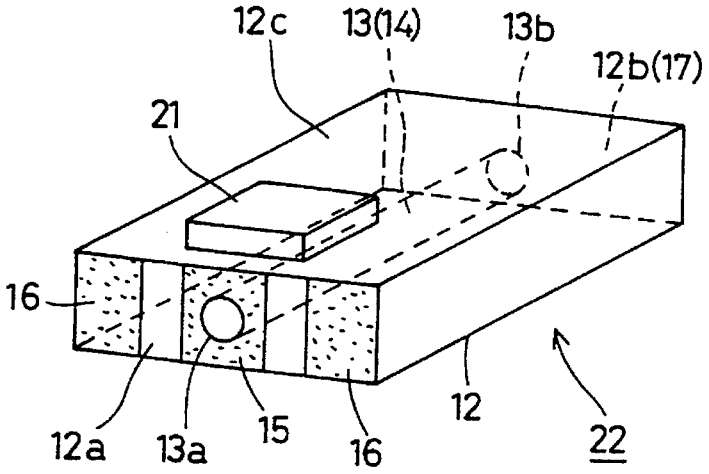
FIG. 3 is a perspective view showing a surface-mountable antenna according to a third embodiment of the present invention.
Figure 4:
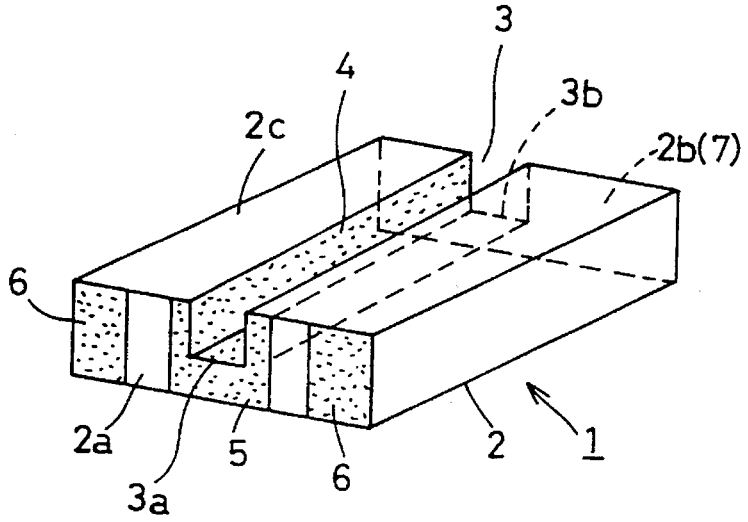
FIG.4 PRIOR ART
FIG. 4 is a perspective view showing a conventional surface-mountable antenna having a groove in its substrate.
Figure 5:
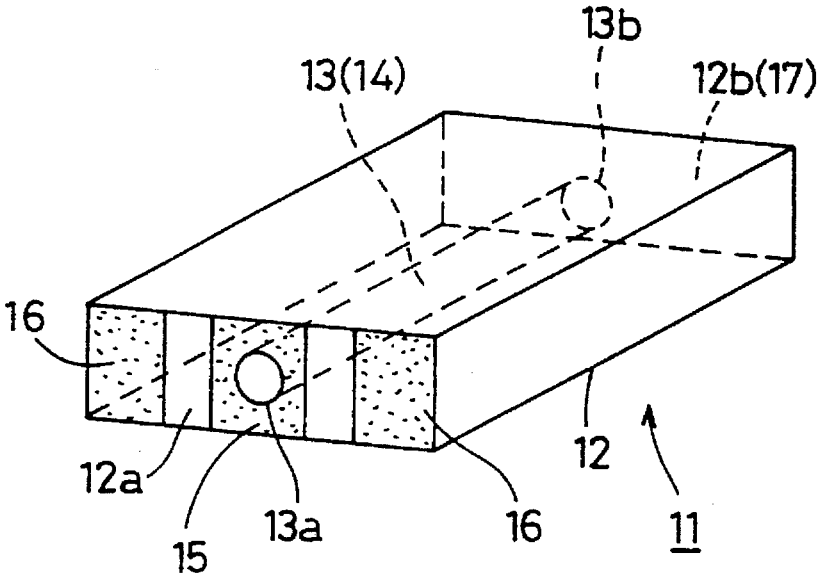
FIG.5 PRIOR ART
FIG. 5 is a perspective view showing another conventional surface-mountable antenna having a through hole in its substrate.

A third embodiment of the present invention is now described with reference to FIG. 3 showing a surface-mountable antenna in a perspective view.

If the resonance frequency of the surface-mountable antenna 11 shown in FIGS. 2A and 2B in perspective views is higher than a desired value, a dielectric member 21 which is made of ceramic or the like is mounted on an upper surface 12*c* of the substrate 12 in a portion close to one opening portion 13*a* of the through hole 13, to form a surface-mountable antenna 22. Due to such mounting of the dielectric member 21, a capacitance component which is present in this surface-mountable antenna 22 is increased. Thus, the value of the resonance frequency as obtained is lowered in the surface-mountable antenna 22. The resonance frequency is thus regulated to a desired value by a method of adjusting the size and the position of the dielectric member 21 for attaining the desired resonance frequency and mounting the same on the substrate 12.

While the third embodiment has been described with reference to a case of mounting a single dielectric member 21 on the upper surface 12*c* of the substrate 12, the present invention is not restricted to this but it is possible to attain a similar effect by mounting a plurality of dielectric members 21 for regulating the capacitance component. For example, it is possible to attain a similar effect by mounting single dielectric members 21 on the upper surface 12*c* of the substrate 12 in portions close to both opening portions 13*a* and 13*b* of the through hole 13. It is also possible to attain a similar effect by mounting a plurality of dielectric members 21 on the upper surface 12*c* of the substrate 12 in a portion close to the opening portion 13*a* or 13*b* of the through hole 13.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A method of regulating the resonance frequency of a surface-mountable antenna, comprising the steps of:

preparing a surface-mountable antenna including a substrate made of a dielectric material, a groove being formed on an upper surface of said substrate to have end portions at a pair of opposite end surfaces of said substrate, a radiating electrode being formed on the inner peripheral surface of said groove, a feeding electrode being formed on one of said pair of opposite end surfaces of said substrate in conductive connection with said radiating electrode, a ground electrode being formed on one of said pair of end surfaces to be insulated from said feeding electrode, and an end electrode being formed on the other one of said pair of opposite end surfaces of said substrate; and partially trimming said radiating electrode, said ground electrode or said end electrode for regulating the resonance frequency of said surface-mountable antenna.

2. The method of regulating the resonance frequency of a surface-mountable antenna in accordance with claim 1, wherein said step of partially trimming said radiating electrode, said ground electrode or said end electrode includes a step of trimming a central portion of said radiating electrode, said ground electrode or said end electrode in such a shape that a continuous peripheral portion of said electrode remains on the dielectric substrate.

3. The method of regulating the resonance frequency of a surface-mountable antenna in accordance with claim 1, wherein said step of partially trimming said radiating electrode, said ground electrode or said end electrode includes a step of trimming part of a peripheral portion of said radiating electrode, ground electrode or said end electrode in such a shape that said electrode partially remains on the periphery of said dielectric substrate.

4. The method of regulating the resonance frequency of a surface-mountable antenna in accordance with claim 1, wherein said step of partially trimming said radiating electrode, said ground electrode or said end electrode includes a step of partially trimming said radiating electrode, said ground electrode or said end electrode with a router.

5. A method of regulating the resonance frequency of a surface-mountable antenna, comprising the steps of:

preparing a surface-mountable antenna including a substrate made of a dielectric material, a through hole being formed in said substrate to have end portions at a pair of opposite end surfaces of said substrate, a radiating electrode being formed on the inner peripheral surface of said through hole, a feeding electrode being formed on one of said pair of opposite end surfaces of said substrate in conductive connection with said radiating electrode, and an end electrode being formed on the other one of said pair of opposite end surfaces of said substrate; and partially trimming said radiating electrode, said ground electrode or said side electrode for regulating the resonance frequency of said surface-mountable antenna.

6. The method of regulating the resonance frequency of a surface-mountable antenna in accordance with claim 5, wherein said step of partially trimming said radiating electrode, said ground electrode or said end electrode includes a step of trimming a central portion of said radiating electrode, said ground electrode or said end electrode in such a shape that a continuous peripheral portion of said electrode remains on the dielectric substrate.

7. The method of regulating the resonance frequency of a surface-mountable antenna in accordance with claim 5, wherein said step of partially trimming said radiating electrode, said ground electrode or said end electrode includes a step of trimming part of a peripheral portion of said radiating electrode, said ground electrode or said end electrode in such a shape that said electrode partially remains on the periphery of said dielectric substrate.

8. The method of regulating the resonance frequency of a surface-mountable antenna in accordance with claim 5, wherein said step of partially trimming said radiating electrode, said ground electrode or said end electrode includes a step of partially trimming said radiating electrode, said ground electrode or said end electrode with a router.

9. A method of regulating the resonance frequency of a surface-mountable antenna, comprising the steps of:

preparing a surface-mountable antenna including a substrate made of a dielectric material, a through hole being formed in said substrate to have opening portions at a pair of opposite end surfaces of said substrate, a radiating electrode being formed on the inner peripheral surface of said through hole, a feeding electrode being formed on one of said pair of opposite end surfaces of said substrate in conductive connection with said radiating electrode, a ground electrode being formed on one of said pair of end surfaces to be insulated from said feeding electrode, and an end electrode being formed on the other one of said pair of opposite end surfaces of said substrate; and mounting a dielectric member on a surface of said substrate in a position close to either one of said opening portions of said through hole for regulating the resonance frequency of said surface-mountable antenna.

10. The method of regulating the resonance frequency of a surface-mountable antenna in accordance with claim 9, wherein said step of mounting said dielectric member includes a step of mounting said dielectric member on said substrate in a position close to one said opening portion of said through hole.

11. The method of regulating the resonance frequency of a surface-mountable antenna in accordance with claim 10, wherein said step of mounting said dielectric member includes a step of mounting at least one additional said dielectric member on said substrate in said position close to said one opening portion of said through hole.

12. The method of regulating the resonance frequency of a surface-mountable antenna in accordance with claim 9, wherein said step of mounting said dielectric member includes a step of mounting single said dielectric members on said substrate in positions close to said opening portions of said through hole respectively.

* * * * *